United States Patent [19]

Grottola

[11] 4,314,703

[45] Feb. 9, 1982

[54] DART GAME AND BOARD

[76] Inventor: Oresto P. Grottola, 9305 S. Velare St., Anaheim, Calif. 92804

[21] Appl. No.: 159,046

[22] Filed: Jun. 13, 1980

[51] Int. Cl.[3] ..... F41J 3/00

[52] U.S. Cl. ..... 273/408; 273/409; 273/139

[58] Field of Search ..... 273/403, 404, 408, 409, 273/407, 139

[56] References Cited

U.S. PATENT DOCUMENTS

| | | | |
|---|---|---|---|
| 2,076,357 | 4/1937 | Tempest | 273/403 |
| 2,179,471 | 11/1939 | Lee | 273/407 X |
| 2,214,486 | 9/1940 | Snyder | 273/409 |
| 3,811,681 | 5/1974 | Sprouse et al. | 273/139 |
| 3,891,214 | 6/1975 | Scullin | 273/408 |

FOREIGN PATENT DOCUMENTS

| | | | |
|---|---|---|---|
| 942332 | 11/1963 | United Kingdom | 273/408 |

*Primary Examiner*—George J. Marlo
*Attorney, Agent, or Firm*—Allen A. Dicke, Jr.

[57] ABSTRACT

Dartboard has a first game side which is divided into fifty-two dart target spaces with each space carrying indicia corresponding to the fifty-two cards of the standard bridge deck. Each target space has a slot adjacent one end thereof into which a slot card each having one of the indicia of the standard bridge deck is inserted to thus hide the indicia from other players. The dart board is rotatably mounted to increase random chance and with the players taking turns throwing darts, dart games employing rules similar to poker and other card games can be played with the board. The reverse of the board is divided into spaces, each of which carries the indicia of one side of a six-sided die. Thus, by throwing darts to the reverse side of the board, games having rules similar to dice games can be played, but also employing dart-throwing skill.

11 Claims, 5 Drawing Figures

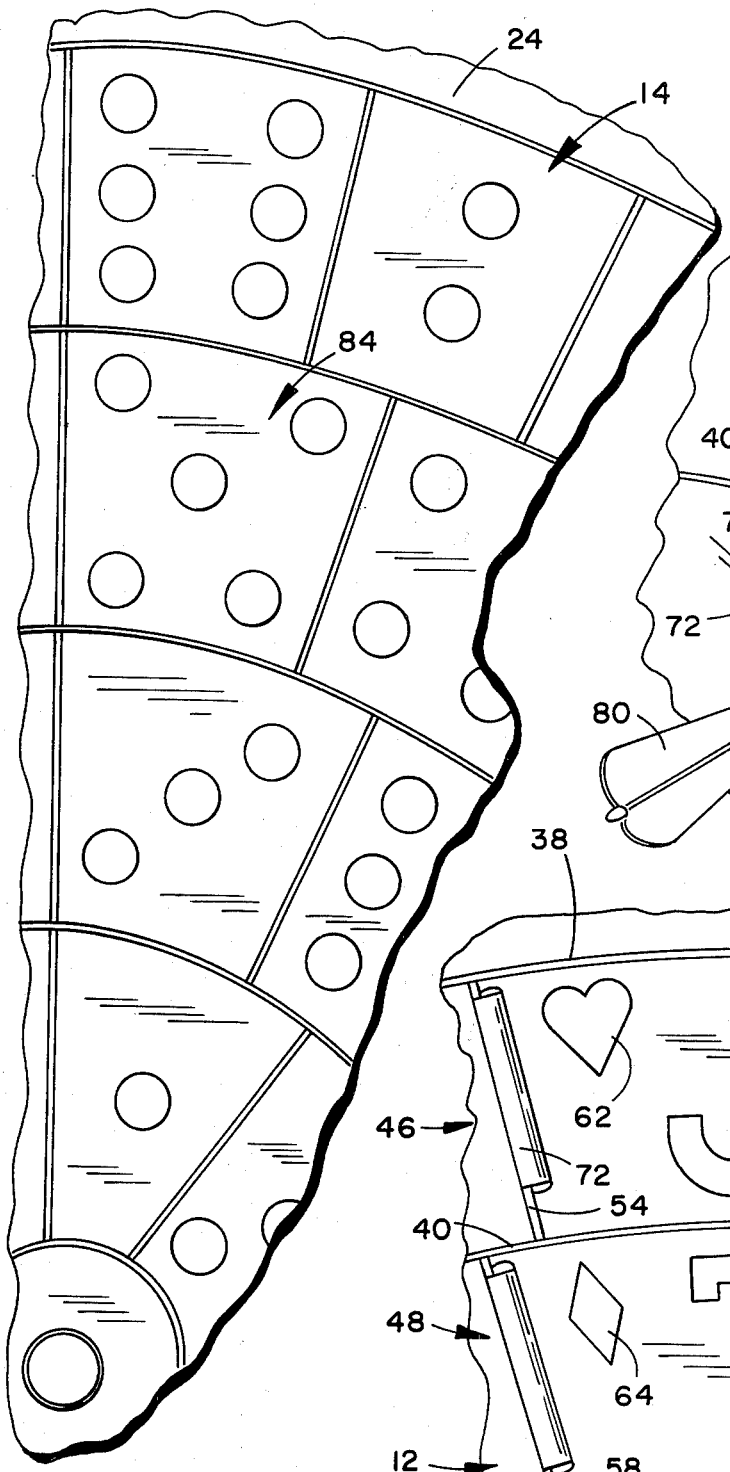
FIG. 3
FIG. 5
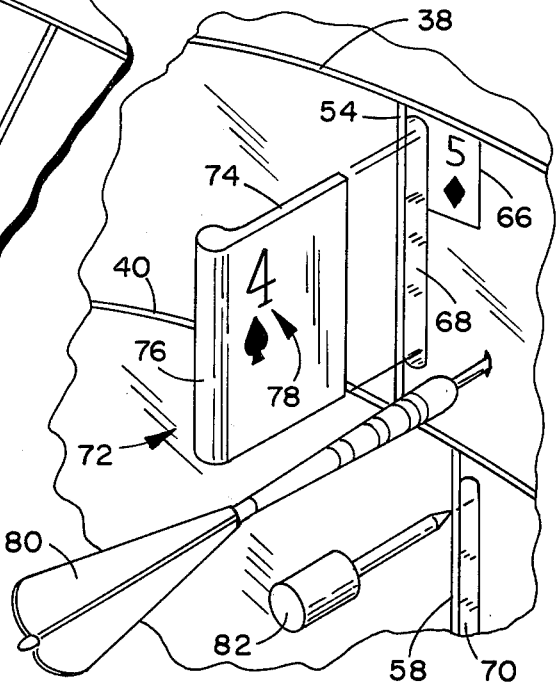
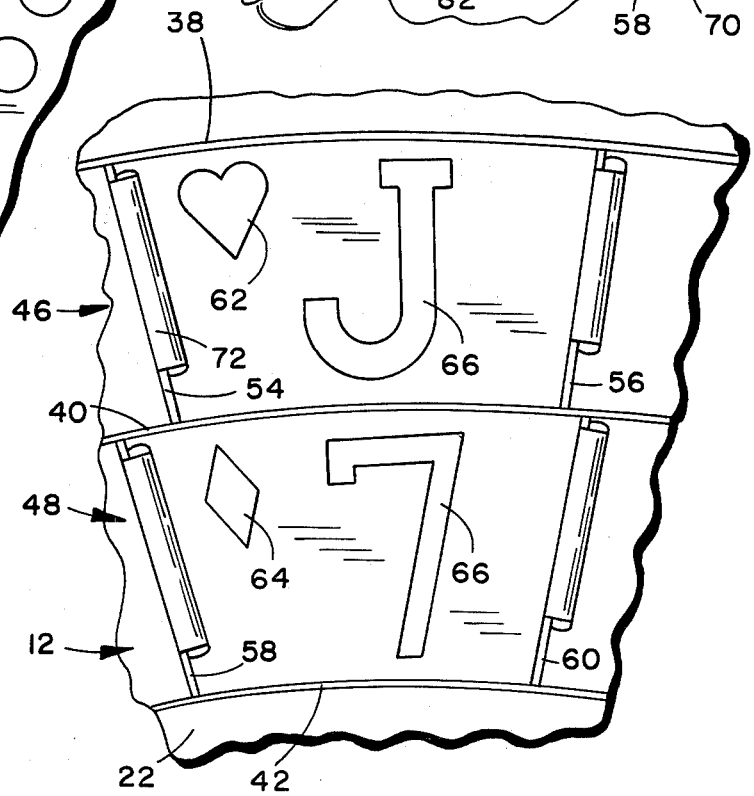
FIG. 4

DART GAME AND BOARD

BACKGROUND

This invention is directed to a dart game and board, and particularly a board which has a side carrying the indicia of a standard bridge deck and, on the reverse thereof, a board carrying the indicia of a standard die.

Dart games have come to us from antiquity. The conventional, modern dart game employs a board which is separated by radial extending rays and circumferential rings. The scoring areas thus defined have different score values, with numerical score values circularly marked around the scoring areas, and with the circumferential rings separating the score areas into score multiple values.

Such a game is interesting, and many people are involved it, but on an informal basis and on a tournament basis. However, games employing the standard dart board are limited to those in which numerical scoring serves as the basis of the game. Thus, there is need for a dart game in which more versatility in game playing rules and ingenuity are achieved.

SUMMARY

In order to aid in the understanding of this invention, it can be stated in essentially summary form that it is directed to a dart game and board, with the board being divided into target spaces, each having an indicia thereon corresponding to the indicia of a standard bridge deck, together with a slot into which a slot card can be inserted, with each slot card having the indicia of a standard bridge deck so that the indicia on the slot card can be hidden from game competitors.

It is thus an object of this invention to provide a dart game and board which is versatile and can be played with rules which correspond to card-playing rules. It is a further object to provide a dart game and board wherein a hole card can be hidden from competitors in the game. It is a further object to provide a dart game and board wherein the reverse side of the board carries thereon scoring areas corresponding to the various faces of the standard die.

Other objects and advantages of this invention will become apparent from a study of the following portion of the specification, the claims and the attached drawings.

BRIEF DESCRIPTION OF THE DRAWINGS

FIG. 3 is an enlarged view, with parts broken away, showing the reverse side and reverse playing area of the board of FIG. 1, as seen along the line 3—3 of FIG. 2.

FIG. 4 is an enlarged portion of the front of the board, as seen generally along the line 4—4 of FIG. 1.

FIG. 5 is an isometric view of a portion of the front of the board of FIG. 1, together with other playing pieces.

DESCRIPTION OF THE PREFERRED EMBODIMENTS

Figure 1:
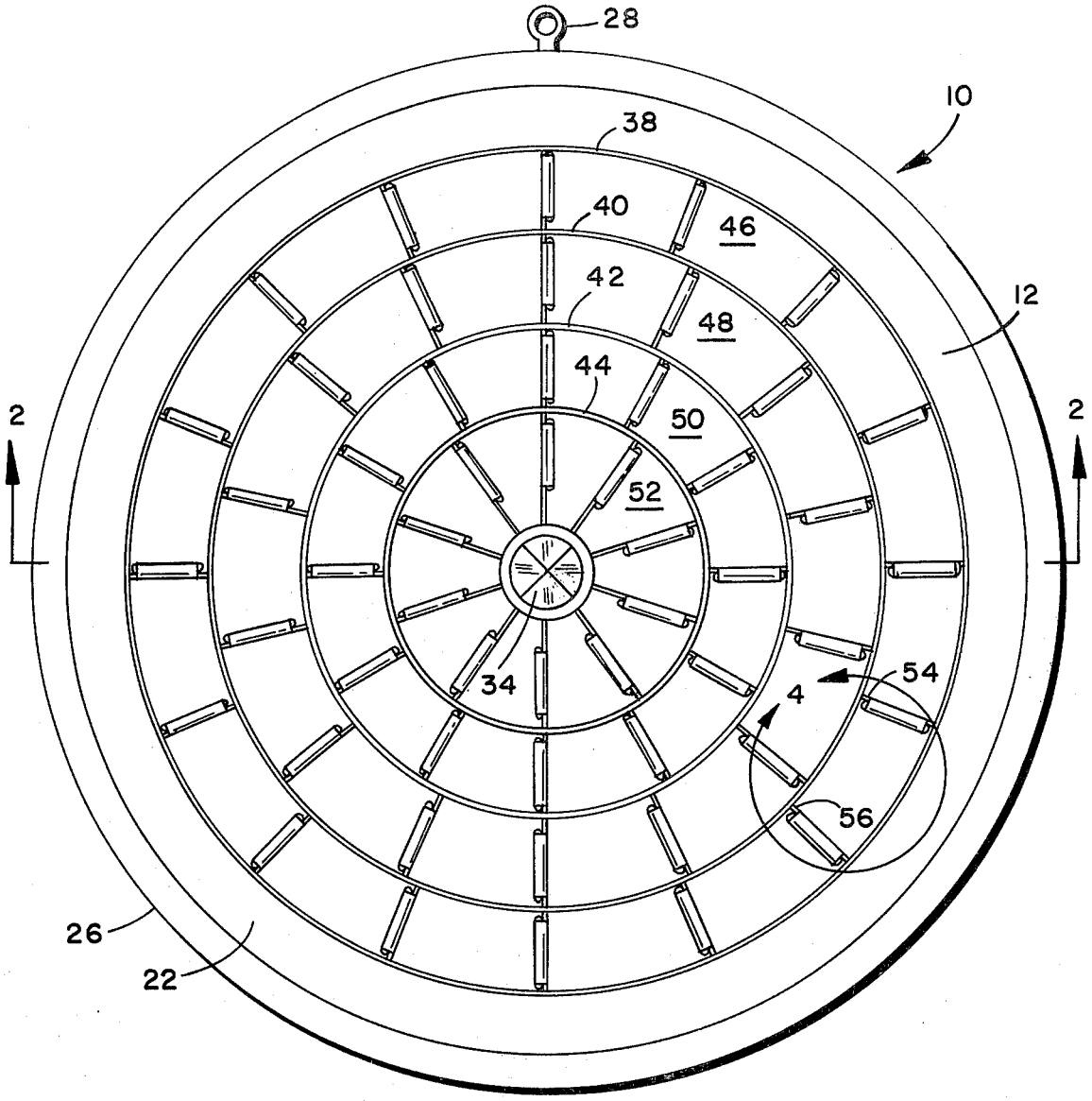
FIG. 1 is an elevational view of the front of the dart board in accordance with this invention.
Figure 2:
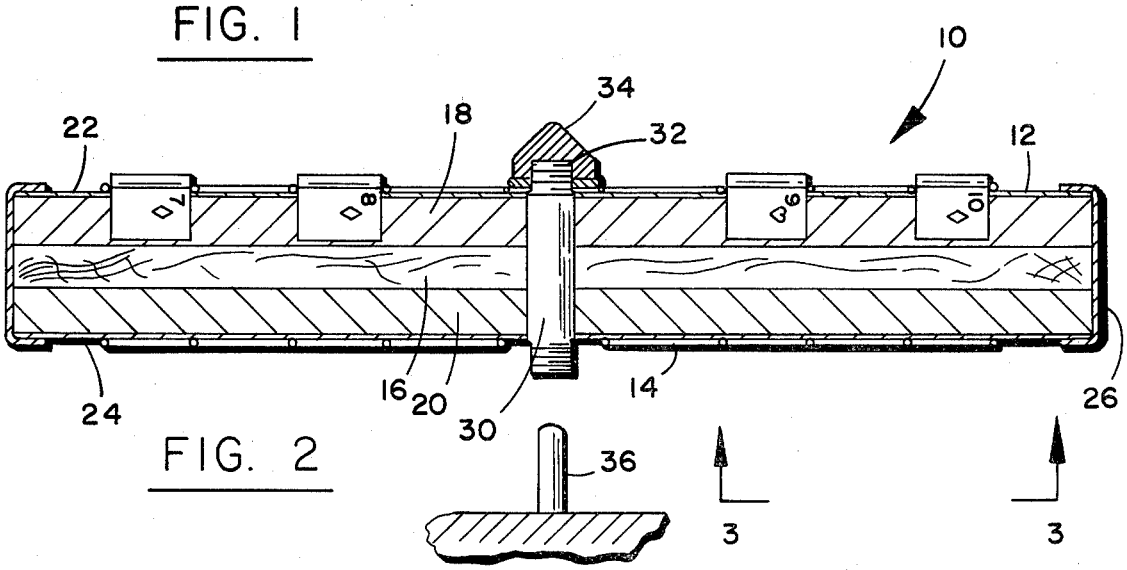
FIG. 2 is a section taken generally along the line 2—2 of FIG. 1.

The dart board of this invention is generally indicated at 10 in FIGS. 1 and 2. Dart board 10 has a front face 12 and a rear face 14, see FIG. 2, although these names are attached for convenience and reference, rather than to indicate the importance of the two faces. As is seen in FIG. 2, dart board 10 is made up of a central strength member 16, for example a plywood disc. Soft face material discs 18 and 20 are respectively secured to the front and rear of the central strength member. The soft face material discs are of suitable material to receive and hold the soft points of darts thrown thereinto. A soft cellulose composition board is suitable for this purpose. Sometimes, a fabric face is provided over the soft face material discs in order to cover the soft material and to provide a surface on which various information can be printed. In the present case, fabric surface 22 is provided on the front and fabric surface 24, on the rear. The fabric is flexible enough that the points of the darts can pass therethrough into the face material discs therebelow. Rim 26 is provided around the periphery of the dart board to finish off the outer circumferential edge. Eye 28, see FIG. 1, is secured into the edge of the dart board, preferably into the central structural member 16, in order to permit the dart board 10 to be hung. The eye is preferably positioned so that either face can be toward the user.

As a more preferred method of positioning the dart board 10, tube 30 extends through the center thereof. Tube 30 is threaded on each end, with threads 32 shown on the end toward the front surface. Cap 34, which is pointed, is threaded onto the end of tube 30 toward the face then being used (in the case of FIG. 2, on the end toward the front face 12). Cap 34 covers the central support tube 30 so that darts cannot enter therein from the active side. When the other side of the dart board is active, then the cap 34 is screwed onto the other end. Tube 30 is carried on a horizontal pin at the correct height for the center of the board so that the board can be mounted thereon. Pin 36 is illustrated in FIG. 2. The central mounting of the board 10 on pin 36 permits the board to be slowly rotated during the dart game in order to decrease the skill in aiming the dart and increasing the random chance of a dart striking any particular scoring area.

Considering the particular scoring areas from the front of the board 10, as seen in FIGS. 1, 4 and 5, circumferential rings 38, 40, 42 and 44 are shown in FIG. 1. These circumferential rings serve, together with the center tube 30, to divide the scoring area of the dart board into annular scoring areas 46, 48, 50 and 52. Each of these areas is divided into equal segments by radially extending dividers. Dividers 54, 56, 58 and 60 are shown in FIGS. 1 and 4. There are ten radial dividers in the smallest ring to divide scoring area 52 into ten radially segmented scoring areas. Similarly, there are twelve such radial dividers in scoring area 50, fourteen radial scoring areas in area 48, and sixteen radial dividers in scoring area 46. This totals fifty-two individual scoring areas, which corresponds to the number of playing cards in the standard bridge deck. The circumferential dividing rings in the radial dividers may be marked on the surface 22, but in the more sophisticated dart boards, these dividers are in the form of brass rule inserts to prevent darts from entering into the dart board on a divider. A different playing card indicia is applied to each of the fifty-two scoring areas. Three of the indicia are indicated at 62, 64 and 66 in FIGS. 4 and 5.

A slot is provided adjacent each radial divider. Slot 68 is illustrated next to divider 54, and a slot 70 is illustrated next to slot 58, both in FIG. 5. A hole card insert is provided for each slot. Hole card insert is illustrated in connection with slot 68 in FIGS. 4 and 5. A similar hole card insert is provided for each of the slots. Hole card insert 72 has a flat blade 74 which can be removably inserted into slot 68. Hole card insert 72 has a rolled outer edge 76 which makes the outer edge thicker. This rolled outer edge extends out over the adjacent radial divider; for example, the rolled edge 76 of insert 72 extends over divider 54 when insert 72 is in place.

There are fifty-two inserts, of which insert 72 is an example, one for each of the fifty-two slots, with one such slot being at the edge of each of the fifty-two target spaces. Each of the inserts carries thereon an indicia, with the indicia 78 being illustrated in FIG. 5. Each of the inserts has a different indicia, each representing one of the cards in the standard bridge deck, and the indicia are each positioned so that, when the inserts are in place in their slots, the indicia are hidden. This hole card insert with its indicia thus corresponds to the down or hole card in Poker.

As an example of one way of playing the dart game with the board 10, the players each, sequentially throw one dart. For example, the first player throws dart 80 which strikes the target area bearing the indicia 66. The first throw, however, is to select a hole card and the player privately withdraws the hole card insert 72 so that he knows what his hole card indicia represents, and then replaces the hole card insert 72 so that it cannot be seen by the other players. In order to mark this hole card, he uses marker 82 which is pointed and colored to represent that particular player. He places the marker into the slot 68 with insert 72 to represent his hole card, and he remembers the indicia. Each of the players sequentially, randomly selects a hole card in that way. Thereafter, each player can have a turn of one, two or three darts, and another marker 82 is used to mark those scoring areas which he has struck with his darts. When four or six indicia-bearing target spaces have been marked for each player, then the winning combination of values determines the winning player in that round. Poker rules for values can be used. As described, dart-throwing skill enters into the kind of Poker hand which can be obtained. If one player is very much more skilled at dart throwing than another, more chance or less still can be employed in the game by slowly spinning the board 10 on its support pin 36.

FIG. 3 illustrates the rear face 14 of the board with its rear fabric surface 24. As illustrated in FIG. 3, rear face 14 is divided by circumferential rings which divide the area into annular scoring areas, and the annular scoring areas are divided into segments by radial dividers. The dividers are preferably each brass rule inserts, and the individual scoring areas are preferably of about the same area. A plurality of such individual scoring areas are shown in FIG. 3. There is preferably a total number of such individual scoring areas which is divisible by six, and the indicia in each of the scoring areas represents the indicia on one of the faces of a six-sided die. Thus, each of the scoring areas has a set of dots therein, from one to six dots, in each of the scoring areas, and preferably there are the same number of each indicia on the rear face of board 10. The five spots of indicia generally indicated at 84 in FIG. 3 represent one of the indicia. Other such spot indicia are shown in the other individual target spaces.

The dart game played in connection with the rear face 14 of the board, as shown in FIG. 3, is similar to any game that employs dice. Two darts are thrown, and the two target areas struck by the arts produce a pair of numbers or a single total number employed in the game. The same player may continue to obtain numbers in that way, or turns can be taken depending upon the character of the game being played. In that way, various games which conventionally employ dice for number selection can be played with the reverse side of board 10. One example of such games is craps. Furthermore, the game can employ some skill in dart throwing in selecting number values. If the random selection of target spaces is more desirable for the particular game, the board 10 can be slowly rotated on a horizontal axis, on its support pin 36. In that case, the cap 34 is unscrewed from the front of the board and screwed onto the tube 30 on the rear face of the board so that the rear face of the board is the effective side for this purpose.

This invention has been described in its preferred contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A dart board comprising:

a front face of material suitable for receiving and detachably retaining the point of a dart, said front face being divided into fifty-two target spaces;

an indicia in each of said target spaces, each of said indicia corresponding to a different one of the indicia on a standard bridge deck of playing cards;

a rear face on said board opposite the front face thereof, said rear face being different than the front face and being divided into a plurality of target spaces, and each of said target spaces on the rear face having therein a plurality of dots, with the dots in any one target space totalling a number between 1 and 6, inclusive, so that a numerical game can be played by throwing darts at the rear face of said board; and said board being circular around an axis, a tube in said board on said axis so that said board may be mounted upon a substantially horizontal pin and rotated upon its axis during the throwing of darts towards said board.

2. The board of claim 1 wherein there is an opening in the front face of said board in association with each of said target spaces and there is an insert removably positioned within each of said openings.

3. The board of claim 2 wherein there is an indicia on each of said removable inserts, said indicia being positioned to be hidden when said insert is within its opening.

4. The board of claim 1 further including at least one dart and at least one marker pin used in association with said board for the playing of a dart game therewith.

5. A dart board comprising:

a front face of material suitable for receiving and detachably retaining the point of a dart, said front face being divided into fifty-two target spaces;

an indicia in each of said target spaces, each of said indicia corresponding to a different one of the indicia on a standard bridge deck of playing cards;

an opening in the face of said board in association with each of said target spaces and an insert removably positioned within each of said openings an indicia on each of said inserts, said indicia being positioned to be hidden when said insert is within its opening, each of said indicia on said inserts being different and each corresponding to one of the indicia on playing cards in a standard bridge deck.

6. The board of claim 5 further including at least one dart and at least one marker pin used in association with said board for the playing of a dart game therewith.

7. The board of claim 5 further including at least one dart and at least one marker pin used in association with said board for the playing of a dart game therewith.

8. The board of claim 5 wherein said board is circular around an axis and there is a tube in said board on said axis so that said board may be mounted upon a substantially horizontal pin and rotated upon its axis during the throwing of darts toward said board.

9. The board of claim 8 wherein there are four rings circumferentially positioned around said axis outside of said tube and each of said rings is divided by a plurality of radial dividers to provide fifty-two target spaces on the face of said board.

10. The board of claim 9 wherein there are ten radial dividers within the innermost of said four rings, twelve radial dividers within the next outermost of said rings, fourteen radial dividers within the next outermost of said rings, and sixteen radial dividers within the outermost of said rings to provide a total of fifty-two target spaces within said outermost ring.

11. The board of claim 5 wherein there is a rear face of said board opposite the front face thereof, said rear face being divided into a plurality of target spaces, and each of said target spaces having therein a plurality of dots, with the dots in any one target space totaling a number between one and six, inclusive, so that a numerical game can be played by throwing darts at the rear face of said board.

* * * * *